US007093449B2

(12) United States Patent
Price et al.

(10) Patent No.: US 7,093,449 B2
(45) Date of Patent: Aug. 22, 2006

(54) STIRLING/PULSE TUBE HYBRID CRYOCOOLER WITH GAS FLOW SHUNT

(75) Inventors: Kenneth D. Price, Long Beach, CA (US); Carl S. Kirkconnell, Huntington Beach, CA (US); Ken J. Ciccarelli, Huntington Beach, CA (US)

(73) Assignee: Raytheon Company, Waltham, MA (US)

( * ) Notice: Subject to any disclaimer, the term of this patent is extended or adjusted under 35 U.S.C. 154(b) by 335 days.

(21) Appl. No.: 10/628,897

(22) Filed: Jul. 28, 2003

(65) Prior Publication Data

US 2005/0022539 A1 Feb. 3, 2005

(51) Int. Cl.
*F25B 9/00* (2006.01)
*F25B 7/00* (2006.01)

(52) U.S. Cl. ..... 62/6; 62/335

(58) Field of Classification Search ..... 62/6, 62/335; 60/520

See application file for complete search history.

(56) References Cited

U.S. PATENT DOCUMENTS 5,412,951 A 5/1995 Wu
5,642,623 A * 7/1997 Hiresaki et al. ..... 62/6
5,647,218 A * 7/1997 Kuriyama et al. ..... 62/6
5,647,219 A 7/1997 Rattray et al.
5,655,376 A 8/1997 Price
6,167,707 B1 1/2001 Price et al.
6,256,998 B1 * 7/2001 Gao ..... 62/6
6,263,677 B1 * 7/2001 Hafner et al. ..... 62/6
6,330,800 B1 * 12/2001 Price et al. ..... 62/6
6,393,844 B1 5/2002 Kirkconnell et al.
2004/0060303 A1 * 4/2004 Haberbusch ..... 62/6

OTHER PUBLICATIONS

Von Schneidemesser, A., et al: "Performance of a single–stage 4 K pulse tube cooler with neodymium regenerator precooled with a single–stage GM refrigerator" CRYOGENICS, Sep. 1, 1999, vol. 39, No. 9, pp. 783–789, IPC Science and Technology Press, Guildford GB.

* cited by examiner

*Primary Examiner*—William C. Doerrler
(74) *Attorney, Agent, or Firm*—John E. Gunther; Leonard A. Alkov; Karl A. Vick

(57) ABSTRACT

A two-stage hybrid cryocooler includes a first-stage Stirling expander having a first-stage regenerator having a first-stage-regenerator inlet and a first-stage-regenerator outlet, and a second-stage pulse tube expander. The second-stage pulse tube expander includes a second-stage regenerator having a second-stage regenerator inlet in gaseous communication with the first-stage regenerator outlet, and a second-stage regenerator outlet, and a pulse tube having a pulse-tube inlet in gaseous communication with the second-stage regenerator outlet, and a pulse-tube outlet. The second-stage regenerator and the pulse tube together provide a first gas-flow path between the first-stage regenerator and the pulse-tube outlet. A pulse tube pressure drop structure has a pulse-tube-pressure-drop inlet in gaseous communication with the pulse-tube outlet, and a pulse-tube pressure-drop outlet, and a gas volume is in gaseous communication with the pulse-tube pressure-drop outlet. A gas flow shunt provides gaseous communication between the first-stage regenerator and the pulse-tube outlet. The gas flow shunt provides a second gas-flow path between the first-stage regenerator and the pulse-tube outlet.

12 Claims, 2 Drawing Sheets

STIRLING/PULSE TUBE HYBRID CRYOCOOLER WITH GAS FLOW SHUNT

This invention relates to a cryocooler and, more particularly, to a two-stage cryocooler whose performance is optimized through management of the gas flows in the refrigeration system.

BACKGROUND OF THE INVENTION

Some sensors and other components of spacecraft and aircraft must be cooled to cryogenic temperatures of about 77° K or less to function properly. A number of approaches are available to perform this cooling, including thermal contact to liquefied gases and cryogenic refrigerators, usually termed cryocoolers. The use of a liquefied gas is ordinarily limited to short-term missions. Cryocoolers typically function by the expansion of a gas, which absorbs heat from the surroundings. Intermediate temperatures in the cooled component may be reached using a single-stage expansion. To reach colder temperatures required for the operation of some sensors, such as about 40° K or less, a multiple-stage expansion cooler is often preferred. The present invention is concerned with applications requiring continuous cooling to such very low temperatures over extended periods of time.

One type of cryocooler used for such applications is a two-stage Stirling/pulse tube cryocooler. Stirling/pulse tube cryocoolers are described, for example, in U.S. Pat. Nos. 6,167,707 and 6,330,800. Briefly, a Stirling expander piston produces refrigeration in the first, warmer, stage. A pulse tube produces refrigeration in the second, colder, stage. Both stages are driven by a pressure wave generated by a reciprocating compressor connected to the inlet of the Stirling-expander first stage.

In the work leading to the present invention, two problems have been observed to limit the performance of the Stirling/pulse tube cryocooler. First, the efficiency falls with lower temperatures, particularly in the pulse tube second stage wherein the working gas is at the lower temperatures. Pulse tube losses consume about 25–40 percent of the gross refrigeration capacity. Second, the compressor pressure wave-to-piston motion phase angle is about ten degrees larger than required for optimal performance.

The Stirling/pulse tube cryocooler has great potential for use in sensor and other cooling applications requiring cooling to low temperatures, but there is a need to overcome these problems to improve its performance even further. The present invention fulfills this need, and further provides related advantages.

SUMMARY OF THE INVENTION

The present approach provides a modified two-stage Stirling/pulse tube cryocooler. The modification addresses both of the problems discussed above, the reduced efficiency at lower temperatures and the phase angle, in each case mitigating the adverse effects. The result is improved efficiency of the two-stage Stirling/pulse tube cryocooler.

In accordance with the invention, a two-stage hybrid cryocooler comprises a first-stage Stirling expander, itself comprising a first-stage regenerator having a first-stage-regenerator inlet and a first-stage regenerator outlet, and also a second-stage pulse tube expander. The second-stage pulse tube expander comprises a second-stage regenerator having a second-stage regenerator inlet in gaseous communication with the first-stage regenerator outlet and a second-stage regenerator outlet, and a pulse tube having a pulse-tube inlet in gaseous communication with the second-stage regenerator outlet and a pulse-tube outlet. The second-stage regenerator and the pulse tube together provide a first gas-flow path between the first-stage regenerator and the pulse-tube outlet. The second-stage pulse tube expander further includes a pulse tube pressure drop structure having a pulse-tube-pressure-drop inlet in gaseous communication with the pulse-tube outlet and a pulse-tube-pressure-drop outlet, and a gas volume in gaseous communication with the pulse-tube pressure-drop outlet. A gas flow shunt provides gaseous communication between the first-stage regenerator and the pulse-tube outlet, wherein the gas flow shunt provides a second gas-flow path between the first-stage regenerator and the pulse-tube outlet. Preferably, the second gas-flow path has a flow capacity of from about 5 to about 30 percent of the first gas-flow path.

Preferably, the gas flow shunt communicates between a first-stage regenerator location at which a gas temperature is substantially the same as the gas temperature at the pulse-tube outlet, and the pulse-tube outlet.

In one embodiment, the gas flow shunt communicates between the first-stage regenerator outlet and the pulse-tube outlet. The pulse-tube outlet may be maintained at the same temperature as the second-stage regenerator inlet. Preferably, the pulse-tube outlet is maintained at the same temperature as the second-stage regenerator inlet and the gas flow shunt communicates between the first-stage regenerator outlet and the pulse-tube outlet.

In another embodiment, the gas flow shunt communicates between the first-stage regenerator inlet and the pulse-tube outlet. The pulse-tube outlet may be maintained at an ambient temperature (which may be room temperature). Preferably, the pulse-tube outlet and the first-stage regenerator inlet are maintained at an ambient temperature (which may be room temperature), and the gas flow shunt communicates between the first-stage regenerator inlet and the pulse-tube outlet.

It is preferred that the gas flow shunt includes a flow-resistance control structure that resists the flow of gas in the gas flow shunt. The flow-resistance control structure may be either passive (no moving parts) or active (moving parts whose movement varies responsive to the flow of gas in the gas flow shunt). The gas flow shunt may also include a biased-flow-resistance control structure, wherein a pressure drop through gas flow shunt is larger when a working gas flows therethrough toward the pulse-tube outlet than when the working gas flows therethrough away from the pulse-tube outlet. The biased-flow-resistance control structure may be either passive or active. The flow-resistance control structure and the biased-flow-resistance control structure may be combined and used together, or used separately.

The effect of the gas flow shunt is to provide the second gas-flow path between the first-stage regenerator and the pulse-tube outlet, in parallel with the first gas-flow path through the second-stage regenerator and the pulse tube. Working gas flowing in the gas flow shunt reaches the pulse-tube outlet faster than does working gas flowing through the second-stage regenerator and the pulse tube in the preferred approach. As a result, the motion of the gas in the gas column within the pulse tube is phase retarded relative to the cycle time.

The alteration of the motion of the gas column in the pulse tube has several beneficial effects. The pressure ratio of maximum-to-minimum cycle pressure is increased. There is a decreased gas mass flow rate through the second-stage regenerator, which reduces pressure drop and enthalpy flow losses in the second-stage regenerator. The phase angle between the pressure wave and the gas-column motion in the pulse tube is optimized. There is a decreased phase angle between the Stirling expander piston and the compressor piston motion.

These changes improve cryocooler performance in several ways. Pulse tube gross refrigeration (defined as total refrigeration, not considering internal parasitic losses) is increased due to the increased pressure ratio and optimized phase angle between the pressure wave and the pulse tube gas flow. The amount of gas that is pumped back and forth through the second-stage regenerator is reduced, which reduces internal heat transfer loss within the second-stage regenerator and increases the available refrigeration. The amplitude of gas-column motion is reduced, which reduces internal heat transfer losses due to gas shear effects within the pulse tube and further increases the available refrigeration. (If the gas piston stroke is reduced, gross refrigeration is reduced; but when the phase angle is optimized, gross refrigeration is restored.) The increases in pressure ratio and the optimization of the phase angle between the pressure wave and the Stirling expander piston increase the first-stage gross refrigeration. The available refrigeration is thereby increased in both stages. Although the cycle pressure ratio is increased, which increases the piston pressure load and the required input power, the reduced phase angle between the pressure wave and the compressor piston compensates for the increased power requirement, resulting in the same or lower drive power to produce the increased refrigeration.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

The physical structure of the two-stage Stirling/pulse tube cryocooler is described in detail in U.S. Pat. Nos. 6,167,707 and 6,330,800, whose disclosures are incorporated by reference. The preferred working gas for the two-stage Stirling/pulse tube cryocooler is helium. The schematic representations of the present FIGS. 1 and 2–3 illustrate this physical structure in a manner that is most conducive to understanding, respectively, the conventional approach and two embodiments of the present approach, in relation to the improvements of the present approach.

Figure 1:
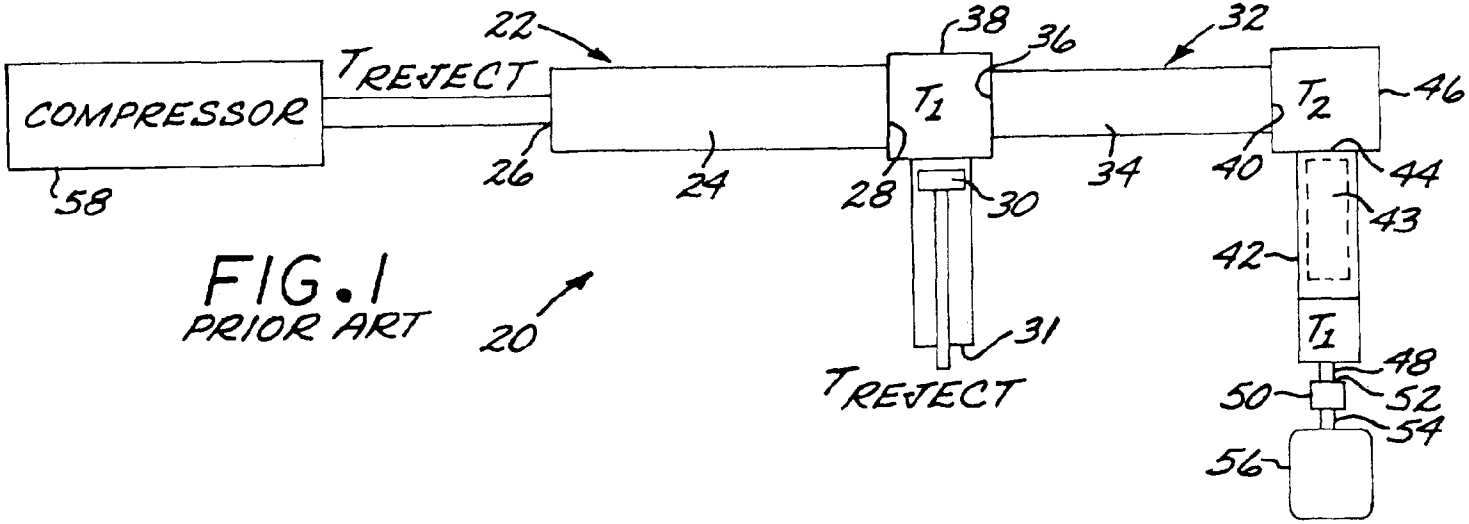
FIG. 1 PRIOR ART
FIG. 1 is a schematic representation of a conventional two-stage Stirling/pulse tube cryocooler.
Figure 2:
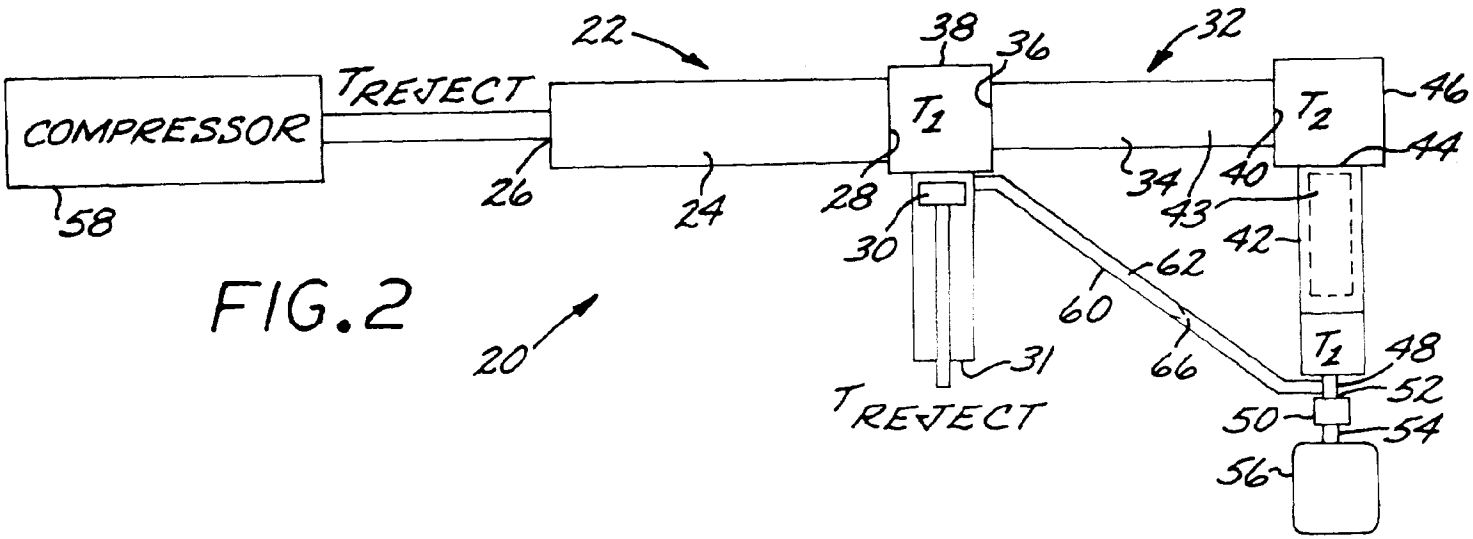
FIG. 2 is a schematic representation of a first embodiment of a modified two-stage Stirling/pulse tube cryocooler according to the present approach.
Figure 3:
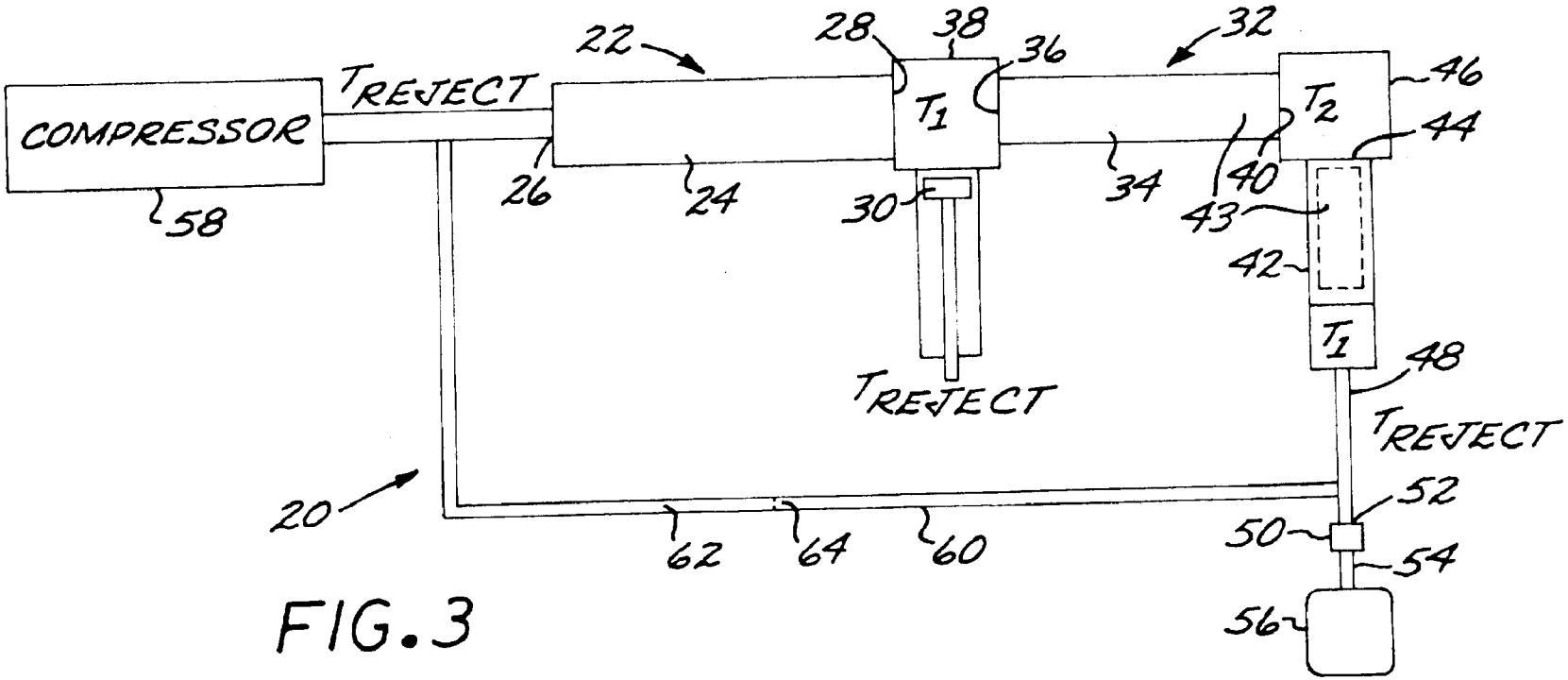
FIG. 3 is a schematic representation of a second embodiment of a modified two-stage Stirling/pulse tube cryocooler according to the present approach.

As seen in each of FIGS. 1–3, a two-stage hybrid cryocooler 20 comprises a first-stage Stirling expander 22. The first-stage Stirling expander 22 includes a first-stage regenerator 24 having a first-stage-regenerator inlet 26 and a first-stage regenerator outlet 28, and a driven Stirling expander piston 30. The first-stage-regenerator inlet 26 and a warm end 31 of the Stirling expander piston 30 are typically operated at $T_{REJECT}$, which is usually ambient temperature (and which may be room temperature or other ambient temperature).

A second-stage pulse tube expander 32 comprises a second-stage regenerator 34 having a second-stage regenerator inlet 36 in gaseous communication with the first-stage regenerator outlet 28 at a first-stage thermal interface 38 that operates at a temperature $T_1$, and a second-stage regenerator outlet 40. A pulse tube 42 has a pulse-tube inlet 44 in gaseous communication with the second-stage regenerator outlet 40 at a second-stage thermal interface 46 that operates at a temperature $T_2$ that is less than $T_1$, and a pulse-tube outlet 48. The second-stage regenerator 34 and the pulse tube 42 together provide a first gas-flow path 43 between the first-stage regenerator 24 and the pulse-tube outlet 48. A pulse tube pressure drop structure 50 has a pulse-tube-pressure-drop inlet 52 in gaseous communication with the pulse-tube outlet 48, and a pulse-tube-pressure-drop outlet 54. The pulse tube pressure drop structure 50 may be, for example, an expansion orifice, a valve, or an inertance tube. A gas volume 56, sometimes called a surge tank, is in gaseous communication with the pulse-tube pressure-drop outlet 54.

A compressor 58 is in gaseous communication with the first-stage regenerator inlet 26. The compressor 58 applies a modulated pressure to the working gas, usually helium, to produce a pressure wave that flows through the remainder of the two-stage cryocooler 20 and powers the first-stage Stirling expander 22 and the second-stage pulse tube expander 32.

The present embodiments of FIGS. 2-3 differ from the approach of FIG. 1 in that a gas flow shunt 60 provides gaseous communication between the first-stage regenerator 24 and the pulse-tube outlet 48. The gas flow shunt 60 provides a second gas-flow path 62 between the first-stage regenerator 24 and the pulse-tube outlet 48, in parallel with the first gas-flow path 43 through the second-stage regenerator 34 and the pulse tube 42.

Preferably, the gas flow shunt 60 communicates between a first-stage regenerator location at which the gas temperature is substantially the same as the gas temperature at the pulse-tube outlet, as will be discussed in relation to the specific embodiments of FIGS. 2 and 3.

In the embodiment of FIG. 2, the pulse-tube outlet 48 is maintained at the same temperature $T_1$ as the second-stage regenerator inlet 36, by making them part of the same physical structure of the first-stage thermal interface 38. The gas flow shunt 60 communicates between the first-stage regenerator outlet 28 (or, equivalently, the second-stage regenerator inlet 36) and the pulse-tube outlet 48. The gas flowing in the gas flow shunt 60 is therefore at a constant temperature of $T_1$.

In the embodiment of FIG. 3, the pulse-tube outlet 48 is maintained at the same temperature as the first-stage regenerator inlet 26, and specifically both are maintained at $T_{REJECT}$, which is normally selected as ambient temperature (which may be room temperature or another ambient temperature). The gas flow shunt 60 communicates between the first-stage regenerator inlet 26 and the pulse-tube outlet 48. The gas flowing in the gas flow shunt 60 is therefore at a constant temperature of $T_{REJECT}$, normally ambient temperature.

The second gas-flow path 62 through the gas flow shunt 60 preferably has a flow capacity of from about 5 to about 30 percent of the first gas-flow path 43. This flow capacity range has been most beneficial in achieving the improved performance results. If the flow capacity of the gas flow shunt 60 is less than about 5 percent of the first gas-flow path 43, there is no substantial benefit realized. If the flow capacity of the gas flow shunt 60 is more than about 30 percent of the first gas-flow path 43, the gross refrigeration produced in the pulse tube drops excessively.

Preferably, the gas flow shunt 60 comprises a flow-resistance control structure 64, such as a flow restriction or orifice, that produces a pressure drop in the gas flowing through the gas flow shunt 60, to aid in controlling the volume flow of gas in the second gas-flow path 62 of the gas flow shunt 60 relative to the first gas-flow path 43. The embodiment of FIG. 2 is illustrated as not having the flow-resistance control structure 64, and the embodiment of FIG. 3 is illustrated as having the flow-resistance control structure 64. However, the flow-resistance control structure 64 may be used with each embodiment of FIGS. 2-3 or not used with each embodiment of.

The gas flow shunt 60 may instead or additionally comprise a biased-flow-resistance control structure 66, wherein a pressure drop through the gas flow shunt 60 is larger when a working gas flows therethrough toward the pulse-tube outlet 48 than when the working gas flows therethrough away from the pulse-tube outlet, or vice versa. This biased-flow-resistance control structure aids in overcoming a DC flow loss due to a circulating gas flow through the closed loop defined by the two gas-flow paths 43 and 62. The embodiment of FIG. 2 is illustrated as having the biased-flow-resistance control structure 66, and the embodiment of FIG. 3 is illustrated as not having the biased-flow-resistance control structure 66. However, the biased flow-resistance control structure 66 may be used with each embodiment of FIGS. 2–3 or not used with each embodiment.

The flow-resistance control structure 64 and the biased-flow-resistance control structure 66 may be passive or active. Examples of passive structures, which have no moving parts, include an in-line orifice within the gas flow shunt 60, a length of small diameter tubing that forms part of the gas flow shunt 60, and a porous bed within the gas flow shunt 60. Examples of active structures, which have moving parts whose movement varies according to the flow of gas in the gas flow shunt 60, include electromagnetically activated louvers, a thermally-modulated/radio-frequency energized conductive flow resistor, a magneto-restrictive device, and a piezoelectric device.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A two-stage hybrid cryocooler comprising:

a first-stage Stirling expander comprising a first-stage regenerator having a first-stage-regenerator inlet and a first-stage-regenerator outlet;

a second-stage pulse tube expander comprising a second-stage regenerator having a second-stage regenerator inlet in gaseous communication with the first-stage-regenerator outlet, and a second-stage regenerator outlet, a pulse tube having a pulse-tube inlet in gaseous communication with the second-stage regenerator outlet, and a pulse-tube outlet, wherein the second-stage regenerator and the pulse tube together provide a first gas-flow path between the first-stage regenerator and the pulse-tube outlet, a pulse tube pressure drop structure having a pulse-tube-pressure-drop inlet in gaseous communication with the pulse-tube outlet, and a pulse-tube-pressure-drop outlet, and a gas volume in gaseous communication with the pulse-tube pressure-drop outlet; and a gas flow shunt providing gaseous communication between a first-stage regenerator location at which a gas temperature is substantially the same as the gas temperature at the pulse-tube outlet and the pulse-tube outlet, wherein the gas flow shunt provides a second gas-flow path between the first-stage regenerator and the pulse-tube outlet.

2. The hybrid cryocooler of claim 1, wherein the gas flow shunt provides gaseous communication between the first-stage regenerator outlet and the pulse-tube outlet.

3. The hybrid cryocooler of claim 1, wherein the pulse-tube outlet is maintained, at the same temperature as the second-stage regenerator inlet.

4. A two-stage hybrid cryocooler comprising:

a first-stage Stirling expander comprising a first-stage regenerator having a first-stage-regenerator inlet and a first-stage-regenerator outlet;

a second-stage pulse tube expander comprising a second-stage regenerator having a second-stage regenerator inlet in gaseous communication with the first-stage-regenerator outlet, and a second-stage regenerator outlet, a pulse tube having a pulse-tube inlet in gaseous communication with the second-stage regenerator outlet, and a pulse-tube outlet wherein the second-stage regenerator and the pulse tube together provide a first gas-flow path between the first-stage regenerator and the pulse-tube outlet, a pulse tube pressure drop structure having a pulse-tube-pressure-drop inlet in gaseous communication with the pulse-tube outlet, and a pulse-tube-pressure-drop outlet, and a gas volume in gaseous communication with the pulse-tube pressure-drop outlet; and a gas flow shunt providing gaseous communication between the first-stage regenerator inlet and the pulse-tube outlet, wherein the gas flow shunt provides a second gas-flow path between the first-stage regenerator and the pulse-tube outlet.

5. The hybrid cryocooler of claim 1, wherein the pulse-tube outlet is maintained at an ambient temperature, and wherein the gas flow shunt provides gaseous communication between the first-stage regenerator inlet and the pulse-tube outlet.

6. The hybrid cryocooler of claim 1, wherein the second gas-flow path has a flow capacity of from about 5 to about 30 percent of the first gas-flow path.

7. The hybrid cryocooler of claim 1, wherein the gas flow shunt comprises a flow-resistance control structure.

8. The hybrid cryocooler of claim 1, wherein the gas flow shunt comprises a passive flow-resistance control structure.

9. The hybrid cryocooler of claim 1, wherein the gas flow shunt comprises an active flow-resistance control structure.

10. A two-stage hybrid cryocooler comprising:

a first-stage Stirling expander comprising a first-stage regenerator having a first-stage-regenerator inlet and a first-stage-regenerator outlet;

a second-stage pulse tube expander comprising a second-stage regenerator having a second-stage regenerator inlet in gaseous communication with the first-stage-regenerator outlet, and a second-stage regenerator outlet, a pulse tube having a pulse-tube inlet in gaseous communication with the second-stage regenerator outlet, and a pulse-tube outlet, wherein the second-stage regenerator and the pulse tube together provide a first gas-flow path between the first-stage regenerator and the pulse-tube outlet, a pulse tube pressure drop structure having a pulse-tube-pressure-drop inlet in gaseous communication with the pulse-tube outlet, and a pulse-tube-pressure-drop outlet, and a gas volume in gaseous communication with the pulse-tube pressure-drop outlet; and a gas flow shunt providing gaseous communication between the first-stage regenerator and the pulse-tube outlet, wherein the gas flow shunt provides a second gas-flow path between the first-stage regenerator and the pulse-tube outlet, wherein the gas flow shunt comprises a biased-flow-resistance control structure, wherein a pressure drop through the gas flow shunt is larger when a working gas flows therethrough toward the pulse-tube outlet than when the working gas flows therethrough away from the pulse-tube outlet.

11. A two-stage hybrid cryocooler comprising:

a first-stage Stirling expander comprising a first-stage regenerator having a first-stage-regenerator inlet and a first-stage-regenerator outlet, and wherein the first-stage regenerator inlet is maintained at an ambient temperature;

a second-stage pulse tube expander comprising a second-stage regenerator having a second-stage regenerator inlet in gaseous communication with the first-stage-regenerator outlet, and a second-stage regenerator outlet, a pulse tube having a pulse-tube inlet in gaseous communication with the second-stage regenerator outlet, and a pulse-tube outlet, wherein the second-stage regenerator and the pulse tube together provide a first gas-flow path between the first-stage regenerator and the pulse-tube outlet, and wherein the pulse-tube outlet is maintained at ambient temperature, a pulse tube pressure drop structure having a pulse-tube-pressure-drop inlet in gaseous communication with the pulse-tube outlet, and a pulse-tube-pressure-drop outlet, and a gas volume in gaseous communication with the pulse-tube pressure-drop outlet; and a gas flow shunt providing gaseous communication between the first-stage regenerator inlet and the pulse-tube outlet, wherein the gas flow shunt provides a second gas-flow path between the first-stage regenerator and the pulse-tube outlet.

12. The hybrid cryocooler of claim 11, wherein the second gas-flow path has a flow capacity of from about 5 to about 30 percent of the first gas-flow path.

* * * * *